US005259351A

United States Patent [19]

Rossignol

[11] Patent Number: 5,259,351

[45] Date of Patent: Nov. 9, 1993

[54] FUEL INJECTION DEVICE, IN PARTICULAR UNIT FUEL INJECTOR

[75] Inventor: François Rossignol, Mornant, France

[73] Assignee: Robert Bosch GmbH, Stuttgart, Fed. Rep. of Germany

[21] Appl. No.: 776,009

[22] PCT Filed: Mar. 1, 1991

[86] PCT No.: PCT/DE91/00179

§ 371 Date: Nov. 22, 1991

§ 102(e) Date: Nov. 22, 1991

[87] PCT Pub. No.: WO91/15674

PCT Pub. Date: Oct. 17, 1991

[30] Foreign Application Priority Data

Mar. 31, 1990 [DE] Fed. Rep. of Germany ..... 4010449

[51] Int. Cl.[5] ..... F02M 37/04

[52] U.S. Cl. ..... 123/506; 123/501; 123/447

[58] Field of Search ..... 123/506, 500, 501, 446, 123/447

[56] References Cited

U.S. PATENT DOCUMENTS 4,448,169 5/1984 Badgley ..... 123/501
4,467,772 8/1984 Williamson ..... 123/501
4,653,455 3/1987 Eblen ..... 123/506
4,811,899 3/1989 Egler ..... 123/299
5,040,511 8/1991 Eckert ..... 123/501

FOREIGN PATENT DOCUMENTS 0207652 1/1987 European Pat. Off. .
2026088 1/1980 United Kingdom .

*Primary Examiner*—Carl S. Miller
*Attorney, Agent, or Firm*—Edwin E. Greigg; Ronald E. Greigg

[57] ABSTRACT

In a fuel injection device, in particular a unit fuel injector, for injecting fuel into fuel-injected internal combustion engines, in which the control of the onset and end of supply is effected by a magnet valve incorporated between a low-pressure circuit and a work chamber of the pump piston. A scavenging bore is provided that can be connected to the work chamber and communicates with a low-pressure chamber or the tank, and a delivery bore of the delivery line originating at the magnet valve intersects the guide bore of the pump piston, instead of providing a separate scavenging bore, the part of the delivery bore remote from the magnet valve and located downstream of the intersection with the guide bore of the piston is utilized as a scavenging bore.

8 Claims, 5 Drawing Sheets

FUEL INJECTION DEVICE, IN PARTICULAR UNIT FUEL INJECTOR

RELATED PATENT APPLICATION

This invention relates to PCT/DE 91/00184 filed Mar. 1, 1991.

The invention relates to a fuel injection device for fuel-injected internal combustion engines, in particular a unit fuel injector, in which the control of the onset and end of supply is effected by means of a magnet valve incorporated between a low-pressure circuit and a work chamber of the pump piston; a scavenging line that can be connected to the work chamber is provided and communicates with a low-pressure chamber or the tank, and a delivery line for delivering the fuel from the magnet valve to the work chamber of the pump piston via a connecting bore intersects the guide bore of the pump piston. In the known injection pumps of this type (European Patent Application A 0 207 652), the scavenging bore is embodied by a separate auxiliary bore, which discharges with circumferential offset with respect to the delivery bore into the guide bore of the pump piston and is opened, in the region of bottom dead center, by the end-face edge of the pump piston. An additional bore of this type is expensive.

The object of the invention is to simplify the construction and to reduce the production cost.

The invention therefore substantially resides in the fact that the portion of the delivery bore remote from the magnet valve and located downstream of the intersection with the guide bore of the piston is utilized as a scavenging bore of the scavenging line. The part of the delivery bore remote from the magnet valve and located downstream of the intersection with the guide bore of the pump piston serves in the known injection pump merely to make it possible to produce the bore. In the known injection pumps, this part of the delivery bore, which is closed at one end, is an idle part. This previously idle part of the delivery bore is now utilized as a scavenging bore, and the product cost for the injection pump is reduced by the elimination of a separate scavenging bore or line.

In the known injection pumps, the delivery bore extends obliquely in the direction of top dead center. This has the advantage that the bore can be made more easily. With this kind of oblique disposition of the delivery bore, it is now advantageously possible, in accordance with a further feature of the invention, for the obliquity to be dimensioned so that one end-face edge of the piston opens the mouth of the scavenging bore, or this otherwise idle part of the delivery bore, in the vicinity of bottom dead center. This makes scavenging of the work chamber at bottom dead center possible.

However, the invention also makes scavenging in the top dead center position of the piston possible. The arrangement is suitably such, that the portion of the delivery bore located downstream of the intersection and utilized as a scavenging bore can be made to communicate via a recess or annular groove of the piston, in the region of top dead center of the piston, with the part of the delivery line, originating at the magnet valve, that communicates permanently with the work chamber of the pump piston via the connecting bore. The communication of the work chamber of the piston with the low-pressure chamber or the tank is now established at top dead center.

A check valve opening in the direction of the low-pressure chamber may be disposed in a branch line of the scavenging line joining this scavenging bore, or the idle part of the delivery bore, to the low-pressure chamber.

The invention is explained schematically in the drawing in terms of the exemplary embodiments.

FIGS. 1 and 2 are details of an embodiment belonging to the prior art, with FIG. 1 being a section taken along the line I—I of FIG. 2 and FIG. 2 being a section taken along the line II—II of FIG. 1. FIGS. 3 and 4 are longitudinal sections through an embodiment which makes scavenging at bottom dead center possible, with FIG. 3 showing the piston at bottom dead center and FIG. 4 showing the piston just before it reaches top dead center. FIG. 5 is a detail of FIG. 3 for a slightly modified embodiment. FIGS. 6 and 7, in longitudinal section, show an exemplary embodiment in which the scavenging is effected in the region of top dead center, where FIG. 6 shows the piston position at bottom dead center and FIG. 7 the piston position in the region of top dead center.

The terms "top dead center" and "bottom dead center" refer to the cam lobe. The term "top dead center" (TDC) is understood to be the dead center position of the piston at the end of the compression stroke, and "bottom dead center" (BDC) is understood to be the piston position at the end of the intake stroke.

FIGS. 1 and 2 show the prior art. Reference numeral 1 is the piston of an injection pump embodied as a unit fuel injector. Reference numerals 2, 3 are a delivery bore of the delivery line, which intersects the guide bore of the pump piston 1. The part 3 of the delivery bore 2 is closed off and represents an idle bore. The scavenging bore 4 is separate and is offset by 90° from the delivery bore 2, 3.

In the embodiment according to the invention shown in FIGS. 3 and 4, reference numeral 5 is the magnet valve. From this magnet valve 5, the fuel flows at fore-pump pressure in delivery bores of a delivery line 6, 7 and from it via a connecting bore 8 into the work chamber 9 of the piston 10. The delivery bore 7 is disposed obliquely and intersects a guide bore 11 of a piston 10, and the part of the delivery line 7 that is idle in the prior art (FIGS. 1 and 2) now represents a scavenging bore 12 of a scavenging line 12, 13, which leads via a branch line 13 to a low-pressure chamber or to the tank.

In the BDC position shown in FIG. 3, an end-face edge 14 of the piston 10 uncovers a mouth 15 of the scavenging bore 12, and the scavenging can now take place at bottom dead center. A check valve 16 is incorporated into the branch line 13 and prevents reaspiration from the low-pressure chamber or tank.

In FIG. 4, the position of the piston is shown near top dead center. In this position, a return flow can take place only via the bore 8, 7 and 6 and via the magnet valve 5.

In FIGS. 3 and 4, the bore 7, 12 is disposed more steeply than in the injection pump of FIGS. 1 and 2 defining the prior art. FIG. 5 shows a variant, in which the bore 7, 12 has the same steepness as in the view of FIG. 1. The piston 10 is reduced to a lesser diameter, however, in the region of its end-face edge 14, so that the recessed end-face edge 14 can again open the mouth 15 of the scavenging bore 12 in the bottom dead center position.

FIG. 6 shows the piston 17 at BDC, in other words at bottom dead center position, and FIG. 7 shows it in the top dead center position. No scavenging takes place in the bottom dead center position in this case.

Figure 1:
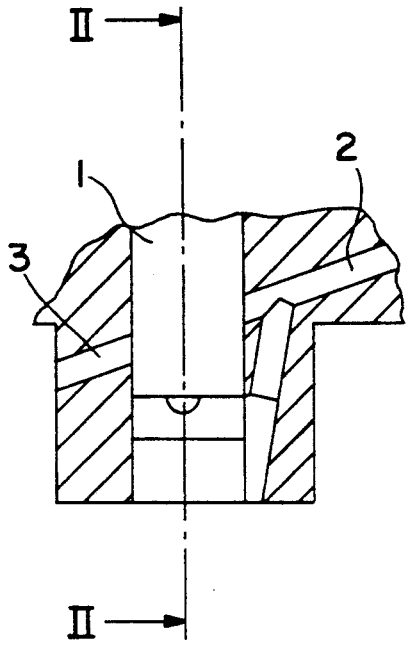
FIG.1 PRIOR ART
Figure 2:
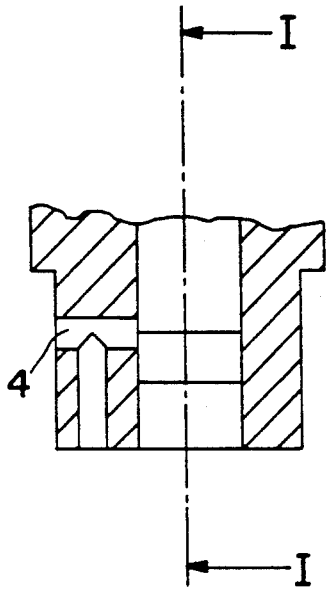
FIG.2 PRIOR ART
Figure 5:
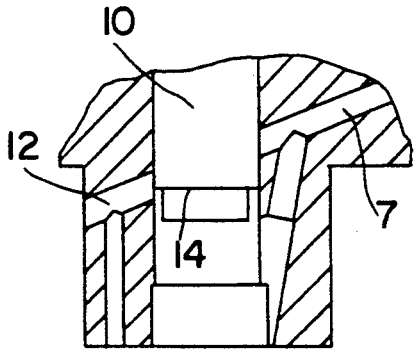
Figure 3:
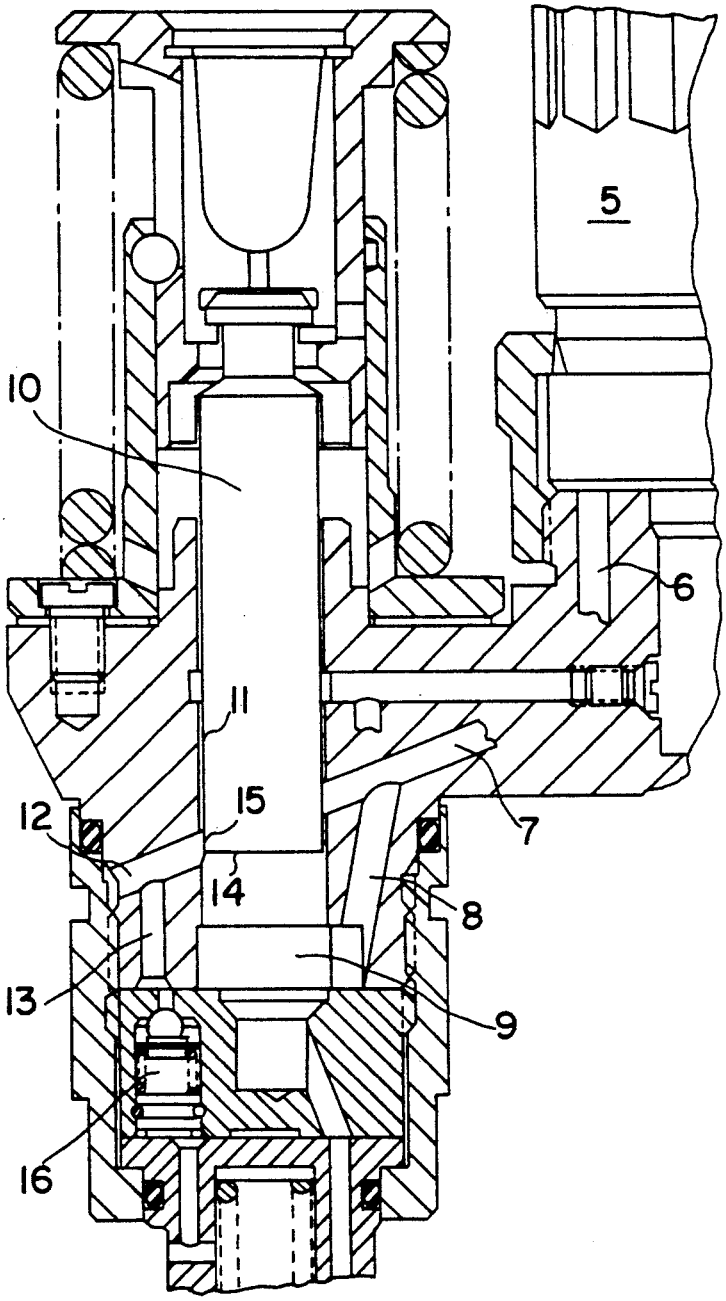
Figure 4:
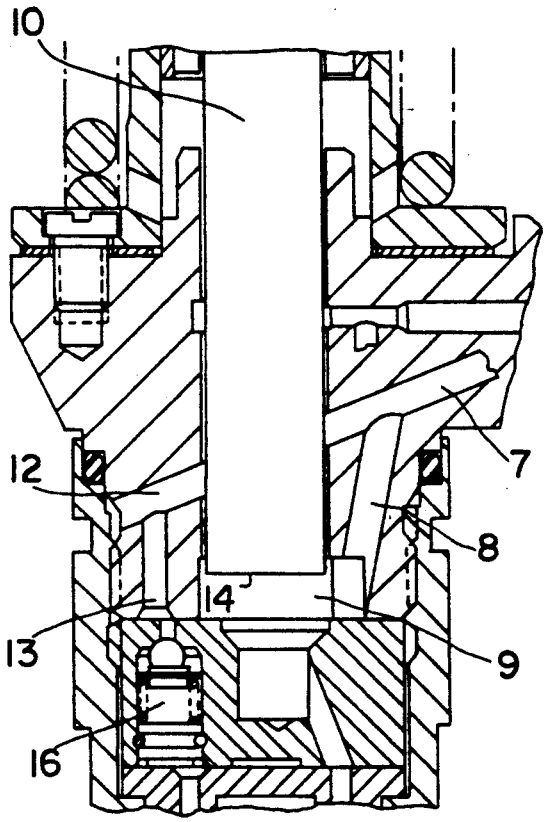
Figure 6:
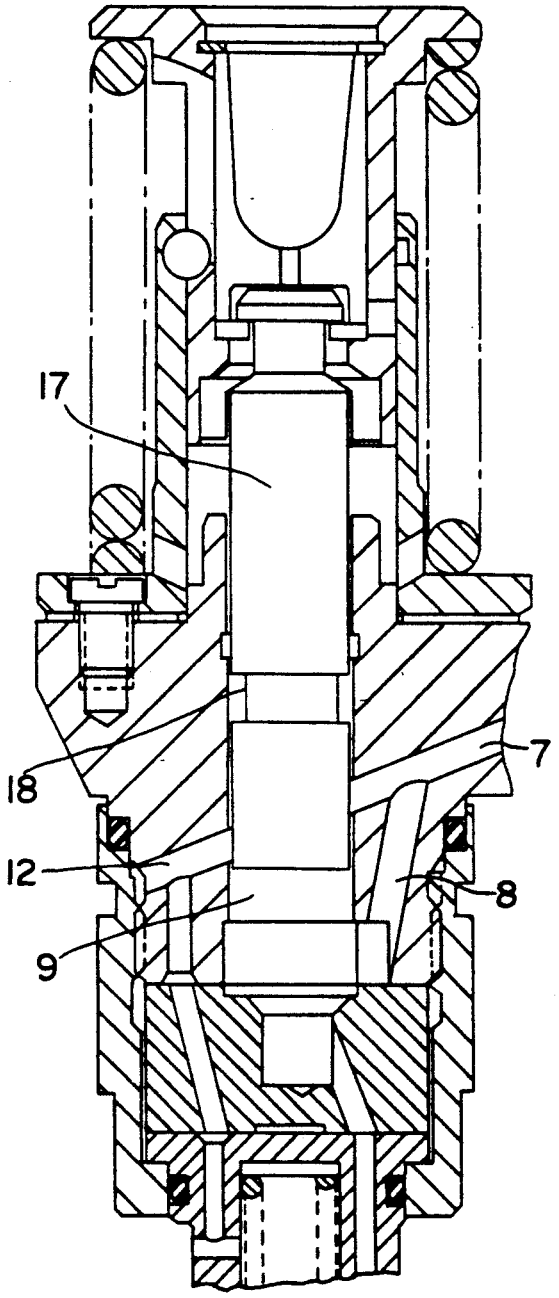
FIGS. 6 and 7 show an embodiment which enables scavenging in the top dead center position.
Figure 7:
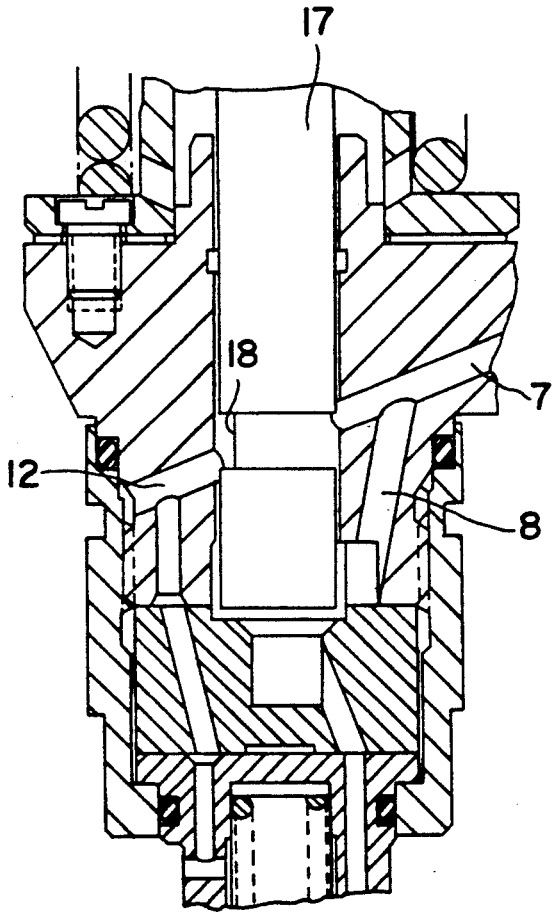

The piston 17 has an annular groove 18. At top dead center (FIG. 7), the delivery bore 7 is made to communicate with the scavenging bore 12 by this annular groove 18, so that the bore 12 is again utilized as a scavenging bore 12. Once again, in the same way as in the exemplary embodiment of FIGS. 3 and 4, the delivery bore communicates permanently via the connecting bore 8 with the work chamber 9 of the piston 17, and in a known manner, independent of the position at a given time of the piston 17, enables control of the supply onset and end of supply in the injection, by means of the magnet valve 5.

The foregoing relates to a preferred exemplary embodiment of the invention, it being understood that variants and embodiments thereof are possible within the spirit and scope of the invention, the latter being defined by the appended claims.

| List of reference numerals: | |
|---|---|
| 1 | pump piston in the prior art |
| 2, 3 | delivery bore in the prior art |
| 4 | scavenging bore in the prior art |
| 5 | magnet valve |
| 6 | delivery bore} |
| 7 | delivery bore} delivery line |
| 8 | connecting bore |
| 9 | work chamber |
| 10 | pump piston |
| 11 | guide bore of the piston |
| 12 | scavenging bore } |
| 13 | branch line of the scavenging line} scavenging line |
| 14 | end-face edge of the piston |
| 15 | mouth of the scavenging bore |
| 16 | check valve |
| 17 | piston |
| 18 | annular groove |

I claim:

1. A fuel injection device for fuel-injected internal combustion engines, in particular a unit fuel injector including a pump piston (10; 17), in which a control of the onset and end of supply is effected by means of a magnet valve (5) incorporated between a low-pressure circuit and a work chamber of the pump piston (10; 17), wherein a scavenging line (12, 13) is provided that can be connected to the work chamber (9), said scavenging line communicates with a low-pressure chamber of a fuel tank, and a delivery bore (7) of a delivery line (6, 7) delivers the fuel from the magnet valve (5) to the work chamber (9) of the pump piston (10; 17) via a connecting bore (8), said delivery bore (7) intersects the guide bore (11) of the pump piston (10; 17), the portion of the delivery bore (7) remote from the magnet valve (5) and located downstream of the intersection with the guide bore (11) of the piston (10; 17) is utilized in continuation as a scavenging bore (12) of the scavenging line (12, 13) which can be connected to the delivery line by a control edge on the pump piston.

2. An injection device as defined by claim 1, in that a check valve (16) opening in the direction of the low-pressure chamber is disposed in a branch line (13) of the scavenging line (12, 13) joining the low-pressure chamber to the tank.

3. An injection device as defined by claim 1, wherein the delivery bore extends obliquely in the direction of top dead center, in that the obliquity is dimensioned so that one end-face edge (14) of the piston opens the mouth (15) of the scavenging bore (12) in the vicinity of bottom dead center.

4. An injection device as defined by claim 1, in that the portion of the delivery bore (7) located downstream of the intersection and utilized as a scavenging bore (12) can be made to communicate, in the region of top dead center of the piston (17), via a recess or annular groove (18) of the piston (17), via a recess or annular groove (18) of the piston (17), with the part (7) of the delivery line (6, 7), originating at the magnet valve (5), that communicates permanently with the work chamber (9) of the pump piston (17) via the connecting bore (8).

5. An injection device as defined by claim 2, wherein the delivery bore extends obliquely in the direction of top dead center, in that the obliquity is dimensioned so that one end-face edge (14) of the piston opens the mouth (15) of the scavenging bore (12) in the vicinity of bottom dead center.

6. An injection device as defined by claim 2, in that the portion of the delivery bore (7) located downstream of the intersection and utilized as a scavenging bore (12) can be made to communicate, in the region of top dead center of the piston (17), via a recess or annular groove (18) of the piston (17), with the part (7) of the delivery line (6, 7), originating at the magnet valve (5), that communicates permanently with the work chamber (9) of the pump piston (17) via the connecting bore (8).

7. An injection device as defined by claim 3, in that the portion of the delivery bore (7) located downstream of the intersection and utilized as a scavenging bore (12) can be made to communicate, in the region of top dead center of the piston (17), via a recess or annular groove (18) of the piston (17), with the part (7) of the delivery line (6, 7), originating at the magnet valve (5), that communicates permanently with the work chamber (9) of the pump piston (17) via the connecting bore (8).

8. An injection device as defined by claim 5, in that the portion of the delivery bore (7) located downstream of the intersection and utilized as a scavenging bore (12) can be made to communicate, in the region of top dead center of the piston (17), via a recess or annular groove (18) of the piston (17), with the part (7) of the delivery line (6, 7), originating at the magnet valve (5), that communicates permanently with the work chamber (9) of the pump piston (17) via the connecting bore (8).

* * * * *